US005147100A

United States Patent [19]

Frankel

[11] Patent Number: 5,147,100

[45] Date of Patent: Sep. 15, 1992

[54] DEVICE FOR RETRIEVING AND SECURELY STORING BALLS

[76] Inventor: Edward B. Frankel, 434 S. Euclid St., Anaheim, Calif. 92802-1247

[21] Appl. No.: 738,926

[22] Filed: Aug. 1, 1991

[51] Int. Cl.[5] ..... B60P 3/00

[52] U.S. Cl. ..... 294/19.2; 414/440

[58] Field of Search ..... 294/19.2; 414/439, 440, 414/441; 56/328.1, 400.11, 400.13, 400.14

[56] References Cited

U.S. PATENT DOCUMENTS

| | | | |
|---|---|---|---|
| 2,482,355 | 9/1949 | McBride | 414/440 X |
| 2,605,005 | 7/1952 | Wenzel et al. | 414/440 |
| 2,729,046 | 1/1956 | Patterson | 414/440 X |
| 3,485,398 | 12/1969 | Offner . | |
| 3,566,893 | 3/1971 | Richardson | 414/440 X |
| 3,593,868 | 7/1971 | Folz . | |
| 3,856,165 | 12/1974 | Gustafson et al. | 414/440 |
| 4,077,533 | 3/1978 | Meyer . | |
| 4,221,524 | 9/1980 | Morris | 414/439 |
| 4,252,490 | 2/1981 | Keller | 414/434 |
| 4,318,654 | 3/1982 | Lee | 294/19.2 X |
| 4,721,428 | 1/1988 | Rohrer et al: | 414/439 |
| 4,792,271 | 12/1988 | Akel | 414/440 |
| 4,844,527 | 7/1989 | Ray | 294/19.2 |

FOREIGN PATENT DOCUMENTS

| | | | |
|---|---|---|---|
| 2558380 | 7/1985 | France | 294/19.2 |
| 2574670 | 6/1986 | France | 294/19.2 |
| 662058 | 9/1987 | Switzerland | 294/19.2 |

*Primary Examiner*—Margaret A. Focarino
*Assistant Examiner*—Joseph D. Pape
*Attorney, Agent, or Firm*—Poms, Smith, Lande & Rose

[57] ABSTRACT

A ball retrieval device includes a main body and a ball collection basket for storing retrieved balls. The basket is shaped substantially as a slotted box. Only a single basket opening, located in a forward peripheral portion of the basket, has a width greater than the diameter of a ball. The collection basket is removably attached to the main body using a pair of upward-turned hooked bracket portions that extend through mesh openings in the basket and allow the basket to remain substantially horizontal when the basket is attached to or removed from the main body. Arms which extend from the main body are provided with an arrangement of resilient fingers, strips, brushes or lips that form a channel in which balls are held when they are adjacent to the arms. These fingers, etc., channel balls along the arms towards a conveyor mechanism located within the main body as the ball retriever is pushed forward.

9 Claims, 2 Drawing Sheets

DEVICE FOR RETRIEVING AND SECURELY STORING BALLS

FIELD OF THE INVENTION

This invention relates to a device for retrieving balls, such as tennis balls, from the ground or from a surface such as a tennis court, and for storing the balls securely until they are reused or transferred to other devices.

BACKGROUND OF THE INVENTION

Almost every tennis player has at one time or another faced the tedious and time-consuming task of retrieving large numbers of tennis balls lying about the court, for example, after a session of practicing serves or other strokes. There are accordingly several devices now available to relieve the player of the tiring necessity of bending over and picking up the balls by hand, one by one.

One common ball retriever is a basket with bottom openings slightly smaller than the diameter of a tennis ball, and with a long handle. To pick up a ball from the court, the player, while standing upright and holding the long handle, pushes the basket down over the ball, which then passes through one of the bottom openings and is trapped in the basket. The main problem with using these baskets is that they usually allow the player to pick up no more than one or two balls at a time.

Much more efficient and less tiresome devices to retrieve balls from a court or other surface resemble shopping carts or "mowers." The user walks normally, pushing the cart before him, and arms that are mainly parallel to the surface of the court and that angle out from the cart try to funnel the balls to a central, revolving drum, belt, or scooper that lifts the balls up from the ground and deposits them into a basket. The tips of the arms are often curved relative to the arms themselves, or are provided with rollers or other devices, in order to support the ends of the arms on the court, or to reduce the tendency of the arms to snag on the net or damage walls.

Crown Manufacturing Company at present manufactures a cart of this type under the name "Ball Mower." In addition, the following patents disclose such carts:

U.S. Pat. No. 3,485,398 (Offner, Dec. 23, 1969);
U.S. Pat. No. 3,593,868 (Folz, Jul. 20, 1971);
U.S. Pat. No. 4,077,533 (Meyer, Mar. 7, 1978);
U.S. Pat. No. 4,221,524 (Morris, Sep. 9, 1980);
U.S. Pat. No. 4,252,490 (Keller, Feb. 24, 1981);
U.S. Pat. No. 4,721,428 (Rohrer et al., Jan. 26, 1988); and U.S. Pat. No. 4,844,527 (Ray, Jul. 4, 1989).

These and other similar devices for retrieving balls have at least two disadvantages that are as common as they are irritating. First, while the user pushes the cart around the court, many balls often bounce away from the arms, particularly out from the curved ends. Also, when the cart changes directions, balls escape from the arms and bounce away, even when the cart is moving slowly.

Second, the collection baskets in these known devices typically do not hold balls securely until they can be reused or transferred to another device such as an automatic "serve cannon." In most known ball retrievers, such as those described in the patents referred to above, the balls that are lifted by the rotating drum, shaft, etc., are dropped either over an edge or through an opening in the collection basket. In many ball retrievers, the basket is open above, and some retrievers require a lid; in others, there is a second opening in the basket. In both cases, in order to remove the retrieved balls from the device, one must pour the balls either through the second opening or directly from the open basket. In both cases, either the balls must be poured slowly, with great care, and with frequent and cumbersome need to move the balls along by hand, or the balls tend to bounce out of the basket back onto the ground.

In the "Ball Mower," for example, the side walls of the ball collection basket are only about five inches high, in part to allow it to be mounted and removed from the main frame of the device. As balls are lifted from the tennis court and are deposited into the basket, balls tend to bounce over one another and many roll over the rim of the basket and out onto the court again. Later, when one wishes to remove the basket and dump the collected balls, for example, into a serve machine, one must tilt the basket, one rim of which is held behind a down-turned metal lip on the main frame of the device, and then pull the basket, still tilted, away from the main frame; balls then tend to fall out of the basket over the basket rim.

The object of this invention is to provide a ball retrieval device that collects and retains balls more efficiently than is now possible using existing devices. In particular, the invention has as its object to prevent balls from "escaping," both when they are being collected from an underlying surface such as a tennis court, and also when they are transferred to another device such as a ball-throwing machine in an easily attached and removed collection basket.

SUMMARY OF THE INVENTION

The ball retrieval device according to this invention includes a main body and a ball collection basket for storing retrieved balls that is shaped substantially as a slotted box. Only a single basket opening, located in a forward peripheral portion of the basket, has a width greater than the diameter of a ball. The collection basket is removably attached to the main body using a pair of upward-turned hooked bracket portions that extend through mesh openings in the basket and allow the basket to remain substantially horizontal when the basket is attached to or removed from the main body.

Arms which extend from the main body are provided with an arrangement of resilient fingers, strips, brushes or lips that form a channel in which balls are held when they are adjacent to the arms. These fingers, etc., channel balls along the arms towards a conveyor mechanism located within the main body as the ball retriever is pushed forward.

DETAILED DESCRIPTION

By way of example, it is assumed that one wishes to collect tennis balls from a tennis court, and then to transfer them to another device such as a ball "cannon," which "shoots" balls over the tennis net to allow a player to practice ground strokes, volleys, etc. The invention can, however, be used to collect other types of balls from other underlying, mainly flat surfaces. As one example, the invention can be used to retrieve baseballs from the ground around a batting cage.

Figure 1:
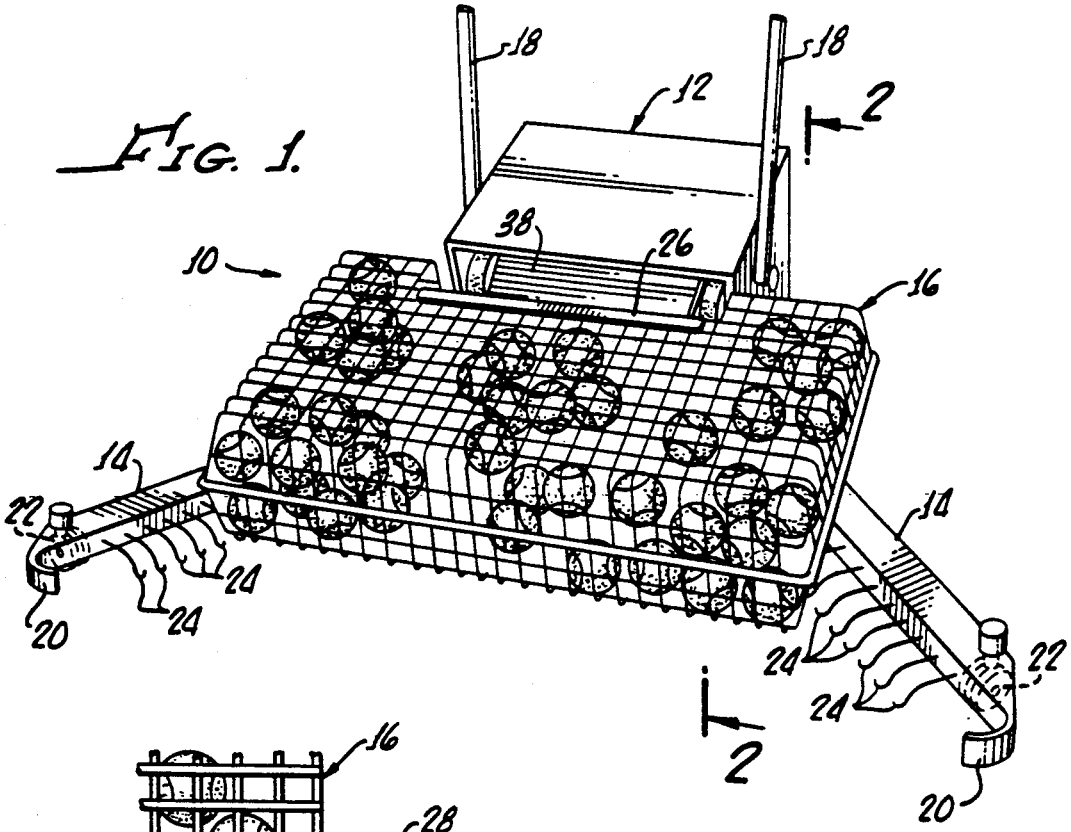
FIG. 1 is a perspective view of a ball collector according to the invention.

In FIG. 1, a ball collector according to the invention is designated generally by the reference number 10. As FIG. 1 shows, the principal components of the ball collector include a main body 12, collection arms 14 that are attached to the main body 12 and can swivel, and a collection basket 16, which is mounted on and can be removed easily from the main body 12. A handle 18 is attached to the main body 12 to allow the user to push and guide the ball collector over the surface of the court (indicated in FIG. 2 by reference number 19).

Each of the two arms 14 is connected to the main body 12 by means of a swivel or pivot (indicated in FIG. 2 by reference number 21) so that they can be swivelled and brought together for storage. In use, however, the arms are swivelled away from each other to form an obtuse angle as shown in FIG. 1; the area between the arms when opened forms a collection or capture area. Balls are collected as they pass between the arms 14 and are thereby funnelled into the main body 12. The main body 12 houses any known transporter or conveyor for lifting collected balls from the court to the basket 16.

At the end of each arm 14 is an inwardly curved tip 20. The tips 20 are commonly found on conventional ball retrievers. The tips 20 are intended to lessen damage to walls and other structures, to lessen the risk of snagging on nets, and to prevent balls from escaping from the arms as the ball retriever turns. The ability of a tip to restrain balls, however, is very poor, since the tip does not hold a ball when the main body 12 is abruptly turned or its direction quickly altered. Each arm 14 is also provided with a wheel 22 such as a castor wheel near the outer tip in order to support the arm and allow it to roll smoothly over the court.

The invention includes two main unique features that improve its ability to keep balls from escaping, both while they are lying on the court between the arms 14 and also when they are collected and deposited in the basket 16. The first of these features is a series of fingers 24 (for the sake of clarity, only some of which are individually numbered), which extend from the inner surface of each arm; the second is that the basket 16 has only a single opening 26 through which balls can pass.

The fingers 24 are securely attached to the arms 14 in any conventional manner, for example by welding, by brackets, or by fitting them through sleeves or holes in the arm (as is illustrated in FIG. 1). The fingers 24, which are preferably resilient rods, are attached at least along the section of each arm which does not lie directly under the basket 16 when it is mounted on the ball collector. In a prototype of the invention, the fingers 24 extended substantially in the plane of the arms 14, but were curved as explained below to form a channel parallel to each arm. When the arms 14 were opened to form an angle of approximately 120 degrees, the fingers 24 extended mainly forward, in the direction of travel of the ball collector, thus forming an angle of approximately 30 degrees with the arms 14.

The outer tip of each finger is preferably curved upward, not only to eliminate sharp tips which could impale or snag balls or court fixtures, but also to help trap balls in a channel adjacent to the arms, as is explained below. The tips of the fingers may alternatively be flattened, smoothed or provided with tip coverings to accomplish essentially the same purpose. The height of the tip of each finger above the court, however, is slightly less than the diameter of a ball. The point of attachment of each finger to the arm is, however, preferably greater than the diameter of a ball.

In a prototype of the invention, for example, the fingers 24 were angled upward approximately 145 degrees beginning about one inch from the tip of each finger, but the distance between the attachment point of each finger and the point at which finger height was less than a ball diameter was always at least one ball diameter. The distance between the fingers 24 is preferably less than the diameter of a ball. The fingers 24 thus form a channel parallel to each arm 14, leading from the tips 20 of the arms toward a transporter or conveyor opening of the collector; balls are substantially free to move in this channel parallel to the arms.

The lengths of the fingers preferably decrease from the arm tips 20 toward the main body 12. In a prototype, the length of the fingers 24 decreased from about five inches near the tips 20 to about two inches nearest the main body 12. The diminishing lengths of the rods helped to direct balls toward the transporter in the main body. The exact lengths of the fingers are not critical as long as they are neither so long that they obstruct the flow of balls into the scooper nor so short that they cannot provide a channel of sufficient width to capture and channel balls; proper lengths sufficient to capture and retain the balls against the arms yet minimally decreasing the distance between the arms are easily determined by experimentation in accordance with the teachings of the present invention. The outermost finger in the prototype, moreover, was kept to a length of three to four inches and extended to meet the curved edge of each arm tip 20 so as to prevent balls from "escaping" from the tip area as the ball collector was turned.

As the ball collector 10 moves forward and balls pass between the arms 14, some pass under the basket 16 directly to the main body 12, where they enter a conventional transporter opening and are transported up to the basket. Some balls come into contact with the arms 14 under the basket 16, and are channelled into the transporter opening as the ball collector moves forward. Most balls, however, typically will bump into the tips of the fingers 24. Since the fingers are resilient, the force of the ball collector moving against these balls will force them under the tips of the fingers and into the channel formed by the fingers. When the ball collector continues forward, the balls will move in the channel toward the main body 12 and into its transporter.

Using existing ball retrievers, which have no fingers, many balls bounce off the arms, out from the capture area, and have to be collected again. Balls also escape from existing retrievers when the retriever turns. For example, viewed as in FIG. 1, assume a ball is close to the tip of the right arm (shown next to the right edge of the drawing sheet), and assume that the ball collector 10 lacks the fingers 24. If the ball collector is rotated counterclockwise (for example, when the player reaches a wall and has to turn around) ball not directly lined up to enter the transporter opening will no longer stay in the collection area, and the player will either have to pick up those balls by hand or will have to try to retrieve them it by pushing the ball collector from a different angle on another pass. In contrast, according to this invention, even when the ball collector turns quickly, any balls which move, relatively, away from the arm 14 will contact the fingers where they are angled downward and they will tend to rebound back toward the arm and can still be channelled toward the main body; they do not escape.

Although the fingers 24 used in the prototype and illustrated in the figures were resilient rods, other types of fingers are possible according to the invention. For example, instead of metal or plastic rods, resilient metal or plastic strips could also be used. Downward-angled brushes (either individual brushes or a single strip brush) could also be used. Furthermore, the rods could also be replaced by a suitably curved or angled strip of rubber, metal or plastic that forms an outward-extending lip running along the length of each arm; such a strip would preferably have a cross section that turns up at its outer edges so that balls can pass easily under the edge as the moving ball collector pushes against them, and a main portion whose height above the court is greater than the diameter of a ball in order to form the channel in which balls can roll freely toward the main body.

The second unique feature of the invention that allows it to hold and transport retrieved balls more securely than do existing ball retrievers is the basket 16. Unlike the baskets or trays found on known ball retrievers, the basket 16 according to the invention is substantially completely enclosed, with only the single edge opening 26 through which retrieved balls pass both when the transporter deposits them in the basket and also when they are dumped out of the basket into another machine. A prototype basket was approximately ten inches deep, as opposed to the five-inch or lower perimeter height of most common baskets. The invention thus makes possible not only a more secure method of retrieving balls, but also enables the user to retrieve many more balls in one pass than is possible using existing devices. As FIG. 1 shows, the basket 16 is preferably made of a conventional wire grid, which not only allows the user to see how many balls have been retrieved or remain in the basket, but also allows the user to dislodge any stuck balls easily by hand.

Figure 2:
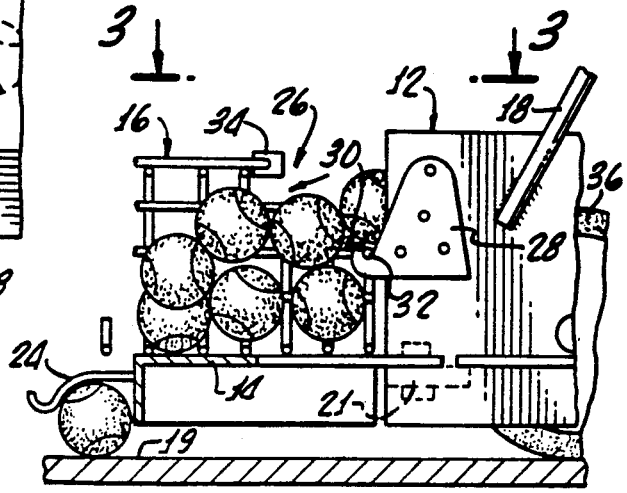
FIG. 2 is a view taken along line 2—2 in FIG. 1 showing the connection between a main body of the ball collector and a collection basket, as well as of balls entering the collection basket.

FIG. 2 shows the preferred method for mounting the basket 16 on the main body 12. Brackets 28, attached to either side of the main body 12 using any conventional method such as welding, riveting, bolts, etc., have a mounting hook portion 30 that extends toward the portion of the basket grid that is adjacent to the main body 12 and then upward (as opposed to the downward-extending holding lips and rims found on existing devices). Alternatively, the hook portions 30 may be formed as portions of the main body itself; however, since the walls of the main body will typically be of formed sheet metal, separate brackets are preferred since they represent less complicated manufacturing and typically will be stronger than their sheet metal alternatives.

When mounting the basket onto the ball collector 10, one moves the basket 16 toward the main body so that the hook portions 30 pass under the uppermost wire 32 at the front vertical portion of the basket 16 at the opening 26. When the basket is then lowered vertically (no tilting is required), the hook portions extend up through corresponding mesh openings between the wires of the basket grid. The wire 32, which forms a connecting edge portion of the basket, then rests on and is secured by the hook portions 30, and the bottom of the basket comes to rest on the arms 14. The hook portions 30 prevent the basket from sliding away from the main body, and the weight of the basket, and of any balls inside it, holds the basket securely in the hook portions.

As FIG. 2 illustrates, the hook portions 30 preferably do not curve back toward the main body 12; if they do at all, the curvature is only slight. This allows the basket 16 to be mounted onto the hook portions 30 without having to tilt the basket and risk balls falling out onto the court again. To remove the basket 16, the user simply lifts it straight up until the basket wire 32 has cleared the hook portions 30, and then moves the basket 16 out away from the main body 12. Since the basket therefore always remains mainly horizontal, no balls fall out through the opening 26.

FIG. 2 also shows that an edge guard 34, preferably a plastic, metal or rubber strip, is mounted over the ends of the wires of the basket mesh that otherwise would extend, exposed, toward the main body 12 and might injure the user or her clothing while the user handles the basket 16. Also shown in FIG. 2 is one of the two or more wheels 36 on which the ball collector 10 rolls as the user pushes it around the court.

Figure 3:
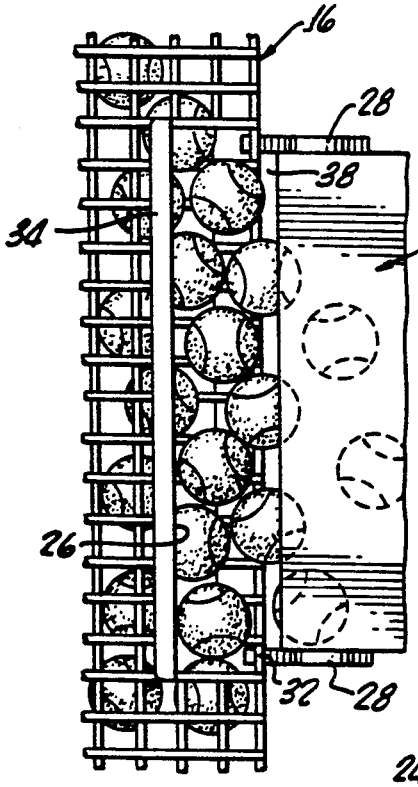
FIG. 3 is a view from above, taken along line 3—3 in FIG. 2, of a section of the main body of the ball collector and of the attached collection basket, and in particular, of an edge opening in the basket.

FIG. 3 is a view from above of the basket 16 mounted on the main body 12. In addition to the features such as the opening 26 and the edge guard 34 of the basket, FIG. 3 also shows a chute 38. The chute 38 is a mainly flat metal ramp in the main body 12 down which balls roll from the internal conveyor or transporter (not shown) and into the basket 16. The chute 38 is also shown in FIG. 1. When the basket is mounted on the main body 12, the opening 26 is directly in front of the chute so as to receive the balls.

Figure 4:
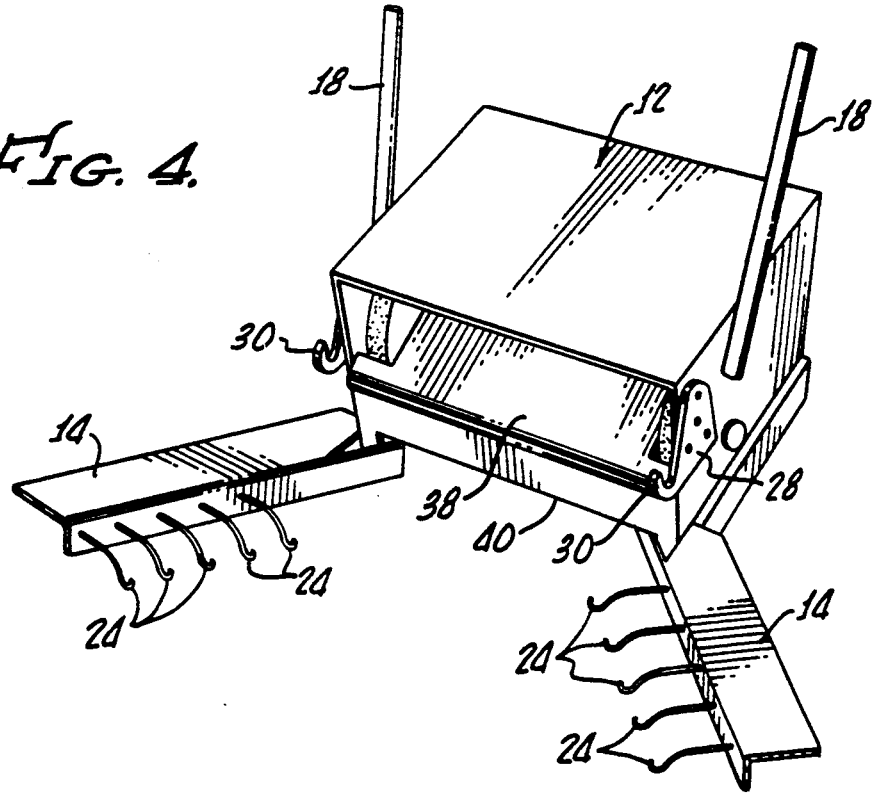
FIG. 4 shows the ball collector with the basket removed.

FIG. 4 is a partially cut-away view of the ball collector with the basket removed, which shows the transporter or conveyor opening 40. Balls that come within the collection or capture area (the area between the opened arms 14) either pass directly into the conveyor opening (under the main body and into a conventional transporter or conveyor mechanism) or are channelled into the opening by the fingers 24. The height of the opening is therefore greater than the diameter of a ball.

Figure 5:
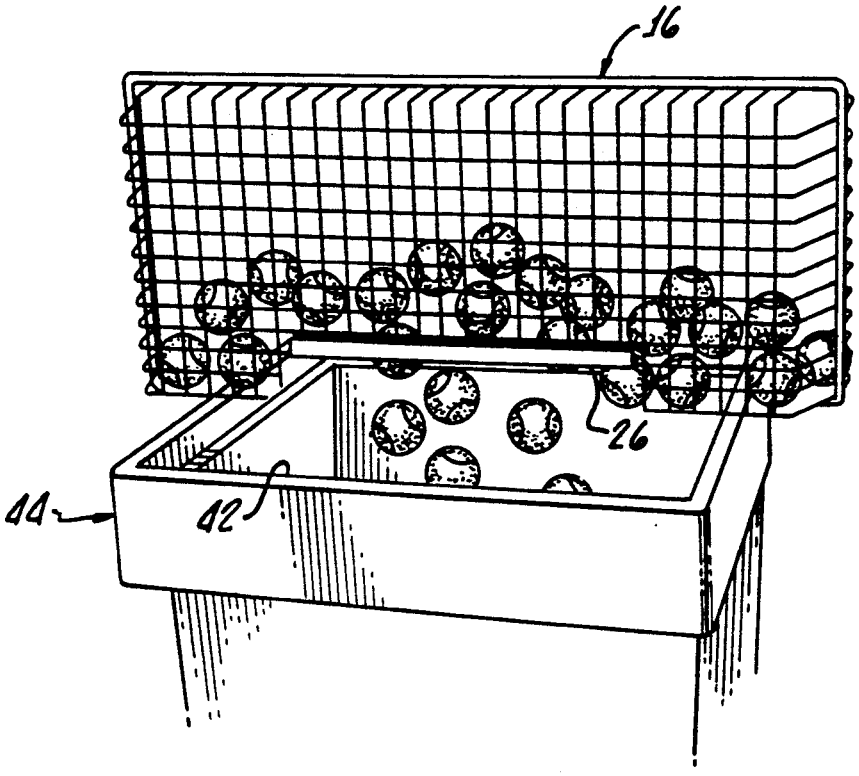
FIG. 5 illustrates the manner and ease with which balls can be transferred to other devices using the basket according to the invention.

FIG. 5 shows the ease with which balls can be carried in the basket 16 and dumped into a hopper 42 of another device such as a ball "cannon" or throwing machine. Thanks to the single-opening structure of the basket 16 according to the invention, if the user removes the basket from the ball collector 10 and carries it with the opening facing up, no balls can fall from the basket; indeed, the user could even *store* a large number of balls in the basket simply by setting it so that the opening faces up, or by using a simple cover (not shown) to close the opening. To load the hopper of the ball-throwing machine, the user simply upends the basket over the hopper 42 and the balls quickly fall out of the basket. Since the basket 16 is formed substantially as a slotted box with only a single multi-purpose opening, there is no risk that balls will "miss" the hopper or fall over any rim of the basket and have to be picked up again. Although some balls to either side of the opening 26 may not fall out of the basket when the basket is first upended, even these balls will reach and fall through the opening 26 and into the hopper 42 when the user shakes or leans the basket from side to side. Furthermore, using the basket according to the invention, the user never has to remove balls by hand, guide them into the hopper, or try to keep other balls from escaping the hopper by rolling over an unprotected rim.

Several alternative designs of the component parts of the ball collector according to the invention have been described above. For example, the collector could also be used to retrieve baseballs from the ground around a batting cage. In this case, the dimensions of the components and openings of the collector would be adjusted to reflect the diameter of a baseball instead of the diameter of a tennis ball. Also, the stiffness of the fingers 24 (or of the alternative strips, brushes or lips) on the arms 14 would preferably be increased to take into account the greater weight of the baseballs. All such modifications are encompassed by the following claims.

I claim:

1. A ball retrieval device for collecting balls from an underlying surface, comprising:

a main body;

a collection basket for storing retrieved balls, said basket shaped substantially as a slotted box, with only a single basket opening, said opening located in a side of said box adjacent to said main body, said opening having a width greater than the diameter of a ball;

connection means, comprising a pair of upward-turned hook portions which extend through mesh openings in the basket, for holding an attachment edge portion of the basket when the basket is mounted on the main body and for removably attaching the basket to the main body while the basket remains substantially horizontal;

a pair of arms, each of which is attached to the main body and which, in an opened position, are substantially parallel to the underlying surface and define between them a capture area; and ball retaining and channelling means attached to the arms for holding balls within the capture area when they come within a predetermined capture distance of the arms, for forming a channel at least as wide as the diameter of the balls, and for restraining balls to move relative to the arms toward said main body when the ball retrieval device is moved substantially forward or is turned.

2. A ball retrieval device for collecting balls from an underlying surface, comprising:

a main body;

a collection basket for storing retrieved balls, said basket shaped substantially as a slotted box, with only a single basket opening located in a side of said box, said side being adjacent to said main body, said opening having a width greater than the diameter of a ball;

a pair of arms, each of which is attached to the main body and which, in an opened position, are substantially parallel to the underlying surface; and connection means comprising a pair of upward-turned hook portions which extend through mesh openings in said basket to hold an attachment edge portion of said basket when the basket is mounted on said main body.

3. A ball retrieval device according to claim 2, in which the connection means comprises brackets secured to side walls of the main body.

4. A ball retrieval device for collecting balls from an underlying surface, comprising:

a main body;

a collection basket for storing retrieved balls;

a pair of arms, each of which is attached to the main body and which, in an opened position, are substantially parallel to the underlying surface and define between them a capture area; and retaining means attached to the arms for holding balls within the capture area when they come within a predetermined capture distance of the arms; said retaining means comprising a channel means for forming a channel at least as wide as the diameter of the balls, and for restraining balls to move relative to the arms toward the main body when the ball retrieval device is moved substantially forward of is turned.

5. A ball retrieval device according to claim 4, in which: the retaining means comprises resilient fingers that extend from each arm into the capture area; and the fingers are distributed along each arm with a spacing less than the diameter of the balls.

6. A ball retrieval device according to claim 5, in which each finger consists of a metal rod.

7. A ball retrieval device according to claim 5, in which each finger has a tip portion whose minimum height above the underlying surface is less than the diameter of the balls, and in which each finger is attached to its respective arm at a height above the underlying surface that is greater than the diameter of the balls.

8. A ball retrieval device according to claim 7, in which the tip portion of each finger is provided with anti-snagging means for allowing balls to snap smoothly under the fingers under the force of contact between the balls and the resilient fingers as the ball retrieval device moves.

9. A ball retrieval device according to claim 5, in which the extension of the fingers from the arms increases with increasing distance of each finger from the main body.

* * * * *